US010030870B2

(12) United States Patent
Arikan

(10) Patent No.: US 10,030,870 B2
(45) Date of Patent: Jul. 24, 2018

(54) PELLET BOILER WITH REMOVABLE GRATE

(76) Inventor: Zeki Arikan, Ankara (TR)

( * ) Notice: Subject to any disclaimer, the term of this patent is extended or adjusted under 35 U.S.C. 154(b) by 746 days.

(21) Appl. No.: 14/388,796

(22) PCT Filed: Sep. 5, 2012

(86) PCT No.: PCT/IB2012/054583
§ 371 (c)(1),
(2), (4) Date: Sep. 26, 2014

(87) PCT Pub. No.: WO2014/037761
PCT Pub. Date: Mar. 13, 2014

(65) Prior Publication Data
US 2015/0053122 A1 Feb. 26, 2015

(51) Int. Cl.
*F23H 1/02* (2006.01)
*F23J 1/00* (2006.01)
(Continued)

(52) U.S. Cl.
CPC ..... *F23H 1/02* (2013.01); *F23H 13/02* (2013.01); *F23H 15/00* (2013.01); *F23H 17/08* (2013.01);
(Continued)

(58) Field of Classification Search
USPC ..... 126/152 R, 174, 176 R, 177, 178, 179, 126/180; 110/268, 281, 290
See application file for complete search history.

(56) References Cited

U.S. PATENT DOCUMENTS 2,742,712 A * 4/1956 McLaren ..... F23H 11/00 110/232
3,198,146 A * 8/1965 Simpson ..... F23H 11/02 110/329
(Continued)

FOREIGN PATENT DOCUMENTS

AU 2008221565 A1 4/2009
CA 2496955 A1 * 8/2006 ..... F23B 80/02
(Continued)

OTHER PUBLICATIONS

CA2496955 A1, downloaded electronically on Mar. 9, 2017. Drawings downloaded as separate document.*
Translation of FR 2522116 retrieved electronically on Mar. 9, 2017. Original copy also included.*
(Continued)

*Primary Examiner* — David J Laux
(74) *Attorney, Agent, or Firm* — Venjuris PC

(57) ABSTRACT

The present invention relates to burners and boiler structures of heating systems which work with solid fuel or which work especially with wood pellets, olive stones and other similar propellants. The burner has a "C"-shaped grate structure comprising a grate mount (4.2) for opening and closing an ash discharging mouth, and the top grate made up by the following components: Grate arms (4.1.2) that can move at a horizontal angle over connecting grate shafts (4.1.3) independent from each other; grate shims (4.1.4) located on the grate shafts (4.1.3) and between the grate arms (4.1.2); a shank (4.1.5) connecting the grate arms (4.1.2) to a grate frame (4.1.1), and the top grate to the grate mount (4.2), thus enabling the top grate to move in an upwards or downwards motion limited by supports (4.1.7, 4.1.8). Furthermore, the burner comprises uneven rails on which the top grate moves guided by guide pins (4.1.6).

14 Claims, 12 Drawing Sheets

(51) Int. Cl.
*F23H 13/02* (2006.01)
*F23H 17/08* (2006.01)
*F23H 15/00* (2006.01)

(52) U.S. Cl.
CPC ..... *F23J 1/00* (2013.01); *F23H 2900/17001* (2013.01)

(56) References Cited

U.S. PATENT DOCUMENTS 3,451,364 A * 6/1969 Andersen ..... F23G 5/002 110/109
4,018,210 A * 4/1977 Christophel ..... F24B 1/1886 126/522
4,103,627 A 8/1978 Mainka
4,475,471 A * 10/1984 Hand, Jr. ..... F23G 5/16 110/345
4,596,437 A 6/1986 Rush
5,027,719 A 7/1991 Chenard
5,265,587 A 11/1993 Carlson

FOREIGN PATENT DOCUMENTS

EP 2400217 A2 12/2011
FR 2522116 A1 * 8/1983 ..... F23H 11/02
GB 2477562 A * 8/2011 ..... F23H 1/00

OTHER PUBLICATIONS

GB 2477562, downloaded electronically on Mar. 9, 2017.*
International search report and documents cited therein.

* cited by examiner

PELLET BOILER WITH REMOVABLE GRATE

TECHNICAL FIELD

The present invention relates to heating systems which use solid fuel, or more specifically pellet and olive stones. In the heating system subject to the invention, solution suggestions which are more improved, more economic and more practical and which are different to the state of the art heating systems are provided. If we approach this subject more specifically, we can say that the present invention presents innovations in the mobile grate structuring located inside the burner structure, in cleaning the grate structure of the burner as practical as possible, in burning the solid fuel by the burner as efficiently as possible, in preventing the lock downs in the system, in eliminating frequent maintenance needs via intelligent cleaning and in cleaning the pipes and burners located inside the heating boiler without an intervention by an operator.

STATE OF THE ART

In general, pellet burners known in the state of the art executes combustion by blowing the air in to the burner. In such type of burners, a valve assembly is used which controls the intake of air according to the data obtained from oxygen sensors (lambda sensor) which measures the oxygen inside the combustion chamber in order to organize combustion. In these type of structures, a high power fan system which is directly connected to the combustion chamber is used, in order to discharge the cinder that has accumulated inside the perforations and double membrane structure of the combustion chamber and in order to unclog the clogged perforations; and this high powered air is used in order to be able to prevent the clogging of air passage pores. However the cleaning system does not allow the complete cleaning of the holes on the surface of the combustion chamber which clog depending on the quality of the fuel and the system thus faces decrease in efficiency and lock downs; which in turns necessitates continuous maintenance and interference. Oscillating systems or systems which enable the linear movement of the grates among themselves are used in certain inventions in order to overcome such problems and the discharging of the cinders that prevent the entry of the air into the combustion chamber is provided. System that are oscillating and which have their own mobile mechanisms, are systems which are far from being able to provide the heating efficiency, and maintenance and cleaning practicality when compared with the system of the present invention. Such systems according to the previous technique have been disclosed in the U.S. Pat. Nos. 4,596,437, 5,265,587, 5,027,719 and 4,103,627.

Even though a mobile grate structure is mentioned in such documents belonging to the previous technique; said mobile grate structures cause expansion due to the materials used and their designs; and because of this expansion, the grate becomes deformed in time and said grate cannot provide the mobility function that is expected from it.

Technical Problems the Invention Aims to Solve

Different to the previous techniques in the present invention a combustion system based on the air suction principle is used instead of the combustion system with air blower; thus ensuring that any kind of unwanted and dangerous gas leakages that might occur as a result of the clogging of the burner grates are prevented and inflammation and possible fire that might arise in the burner feeding section and fuel tank due to the back firing of the flame is eliminated. Also with the aid of the pipe structure with spring coil located inside the heating pipes placed inside the boiler, the passage of hot air through the low resistance area located inside the pipe centre without going through a heat transfer phase is prevented and the hot air that sweeps over the pipe surfaces are increased, thus positively effecting the heat efficiency of the system. With the help of this coil structure inside the inner pipe structure, and with the help of the driving motor(s) that apply a lifting and releasing motion from above to said coil structures, the possible soot and contamination that may occur on the pipe is prevented; thus preventing the energy losses arising due to stopping the boiler and cooling it in order to clean it and ensuring the continuous and efficient operation of the boiler. Moreover the most important problem in the systems in which solid fuel and especially pellet fuels are used is the clogging of the channels on the grate that enable the intake of air into the combustion chamber due to waste and cinders arising from the burned pellets and for the efficiency of the system to decrease as a result of insufficient feeding of air to the combustion chamber or even for the system to break down and stop operating after a short while following clogging.

In such systems where pellet fuels are used, the inner chamber can only be reached after the whole system is stopped, cooled down and all the burner connection parts are dismantled; thus causing a severe loss of energy and effort. By means of the system subject to the invention the sweeper (13) mechanism located on the grate which has independent arms, carries out a sweeping motion on the grate and cleans the waste and cinders clogged between the channels, that have accumulated on the grate, when deemed necessary the grate can be taken out without needing to dismantle the burner, all necessary maintenance and cleaning processes can be carried out and the cleaning problem can be overcome; wherein according to the invention by the purpose of increasing the combustion efficiency, primary and secondary air is aimed to be transferred to the combustion chamber via completely separate channels and by this means the primary and secondary air amounts can be arranged independent from each other. Moreover the burner, combustion chamber, grate, primary and secondary air channels together form one piece; wherein by dismantling 6 bolts (12), the burner can be independently taken out from the boiler unit thus ensuring maintenance and part changes to be carried out feasibly. Especially owing to the grate structure subject to the invention, the clogging of the system is prevented by providing steady air intake which further leads to a continuous and efficient combustion. Carrying out external cleaning and intervention processes have nearly been completely eliminated. As all of the parts of the system are equipped with driving motors and sensors that synchronously work with each other; the system can be operated with only one button thus providing a user friendly structure.

BRIEF DESCRIPTION OF THE DRAWINGS

Burner.

Figure 1A:
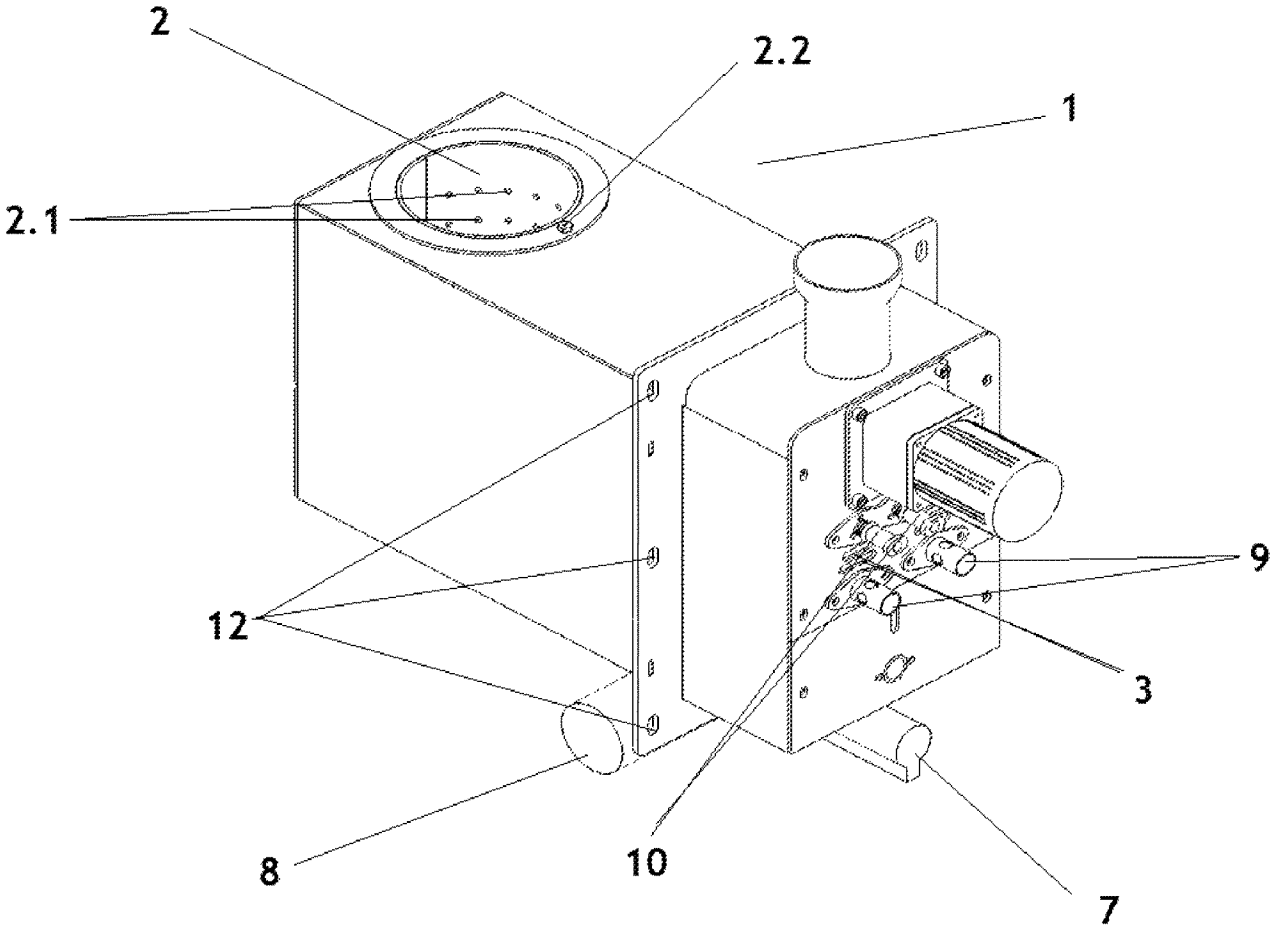
FIG. 1A is the integrated view of the burner.
Figure 1B:
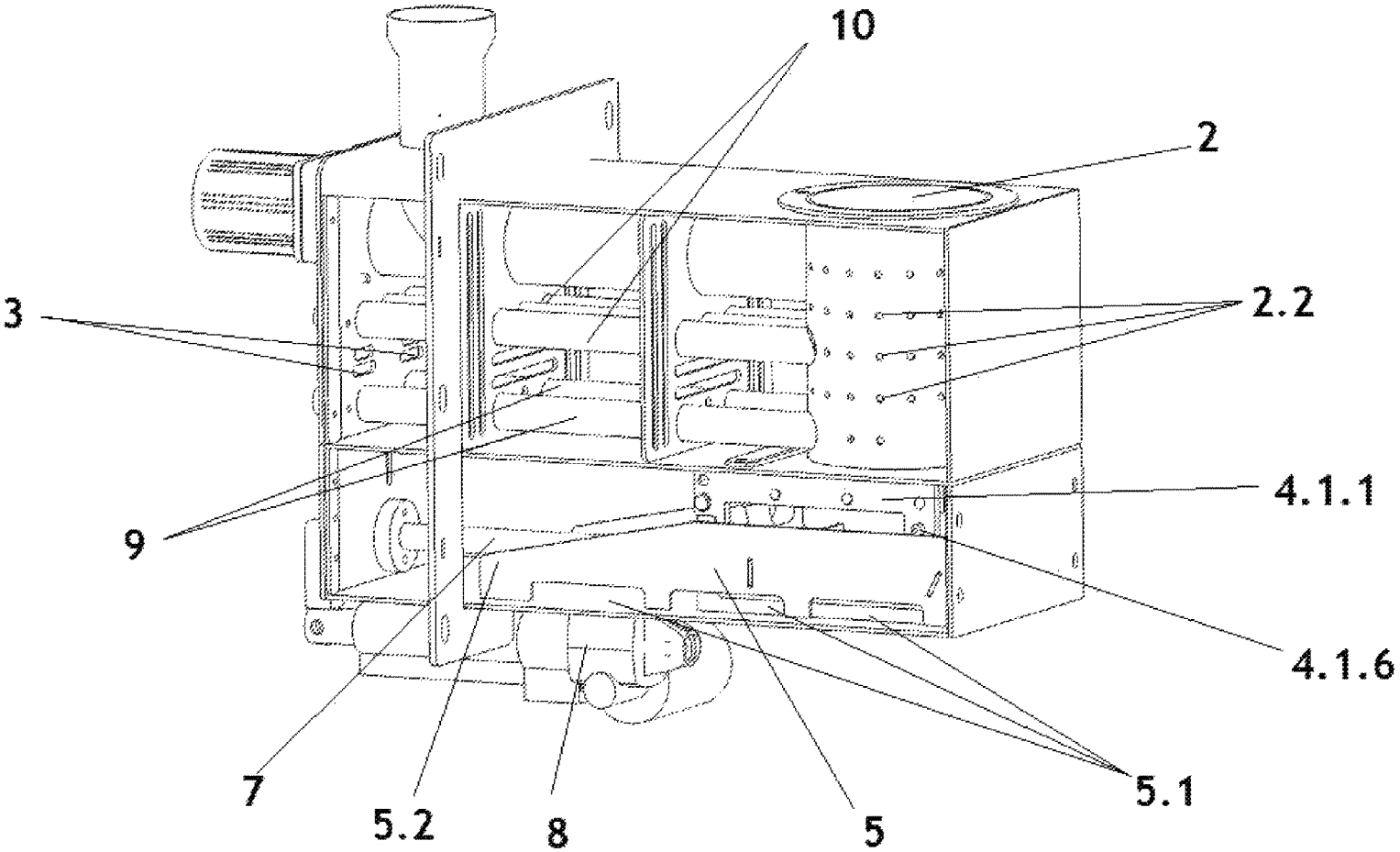
FIG. 1B is the inner view of the burner
Figure 1C:
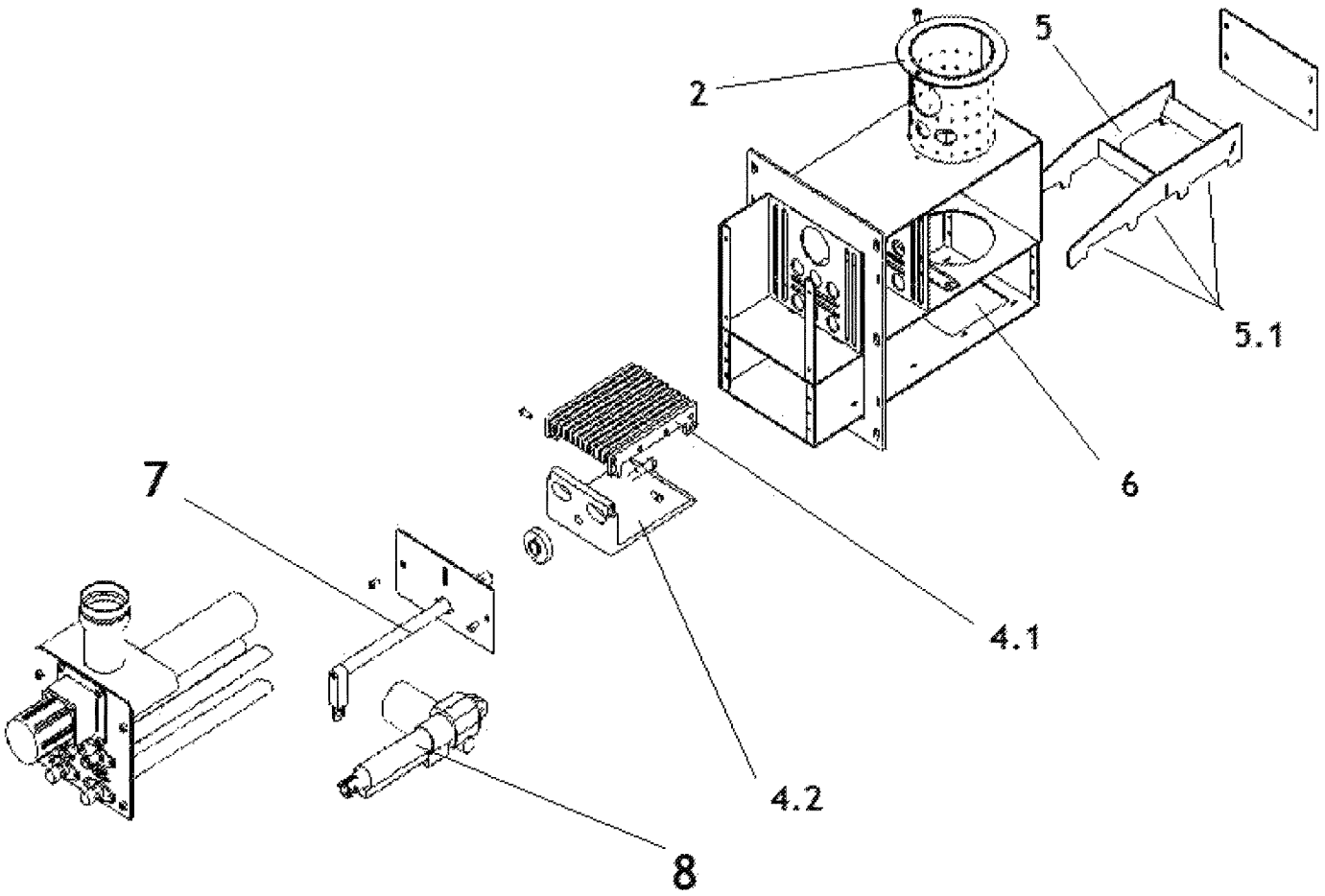
FIG. 1C is the exploded view of the burner
Figure 2A:
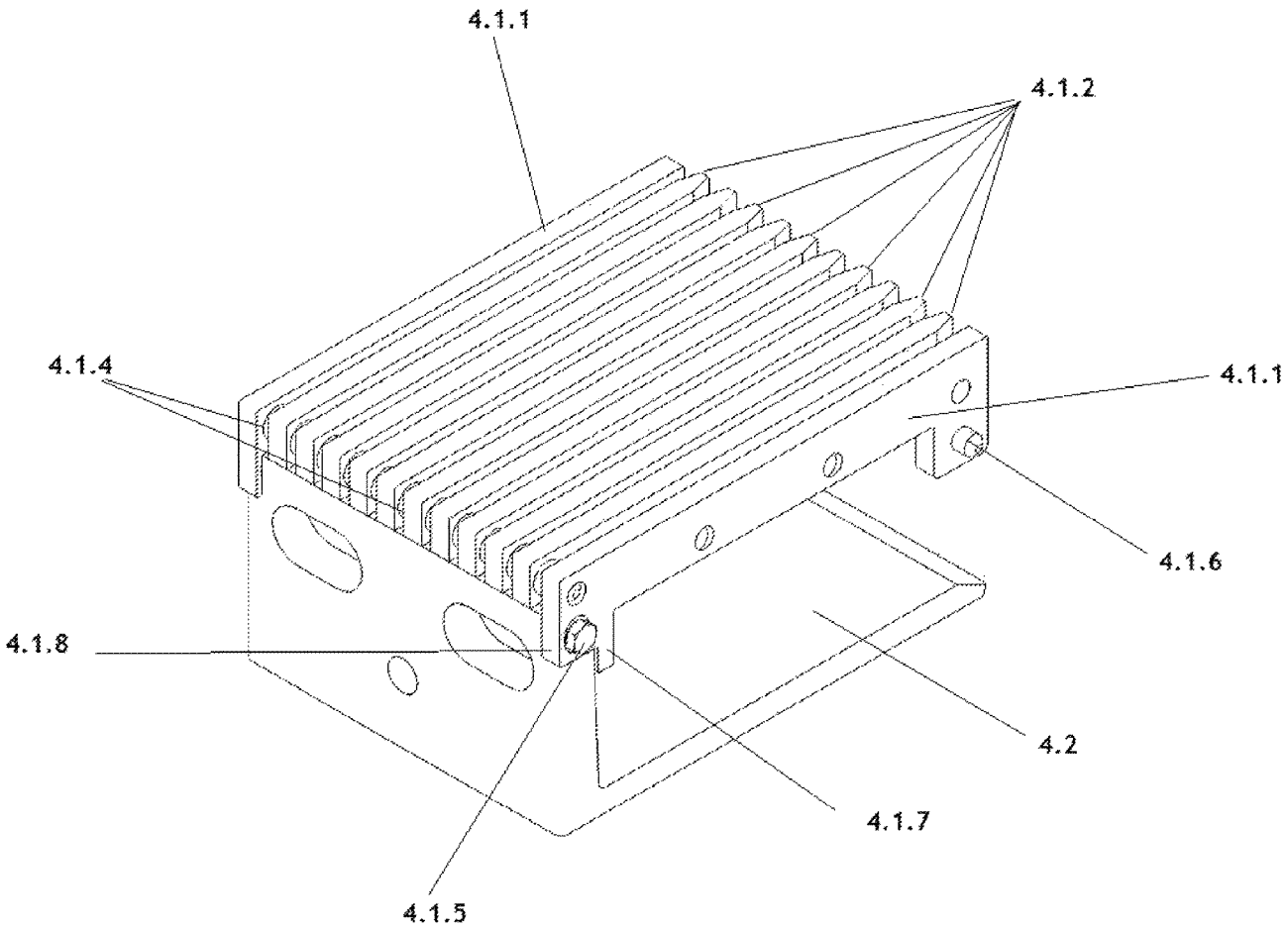

Grate:

FIG. 2A—Is the general view of the grate

Figure 2B:
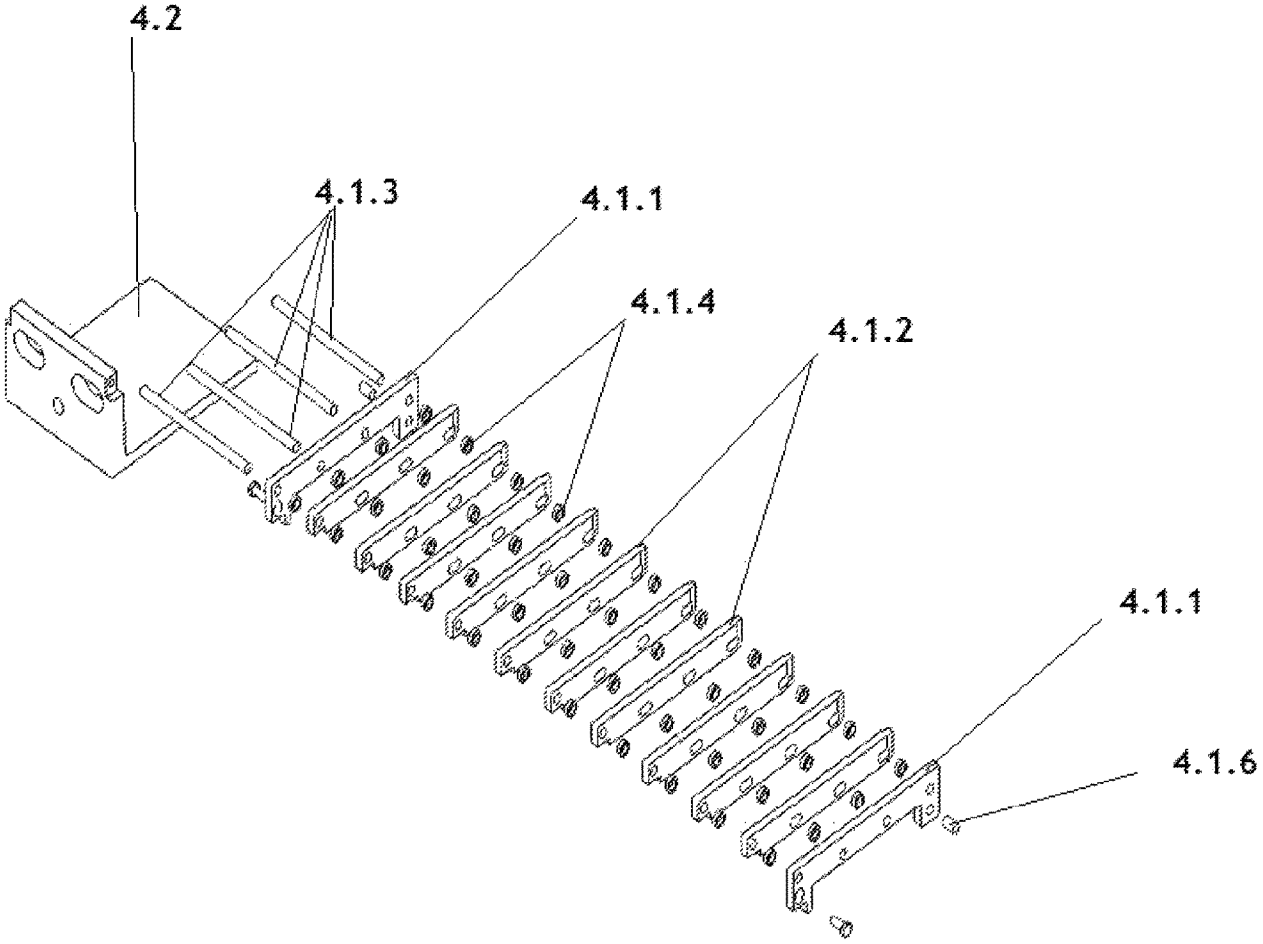

FIG. 2B—Is the exploded view of the grate

Figure 2C:
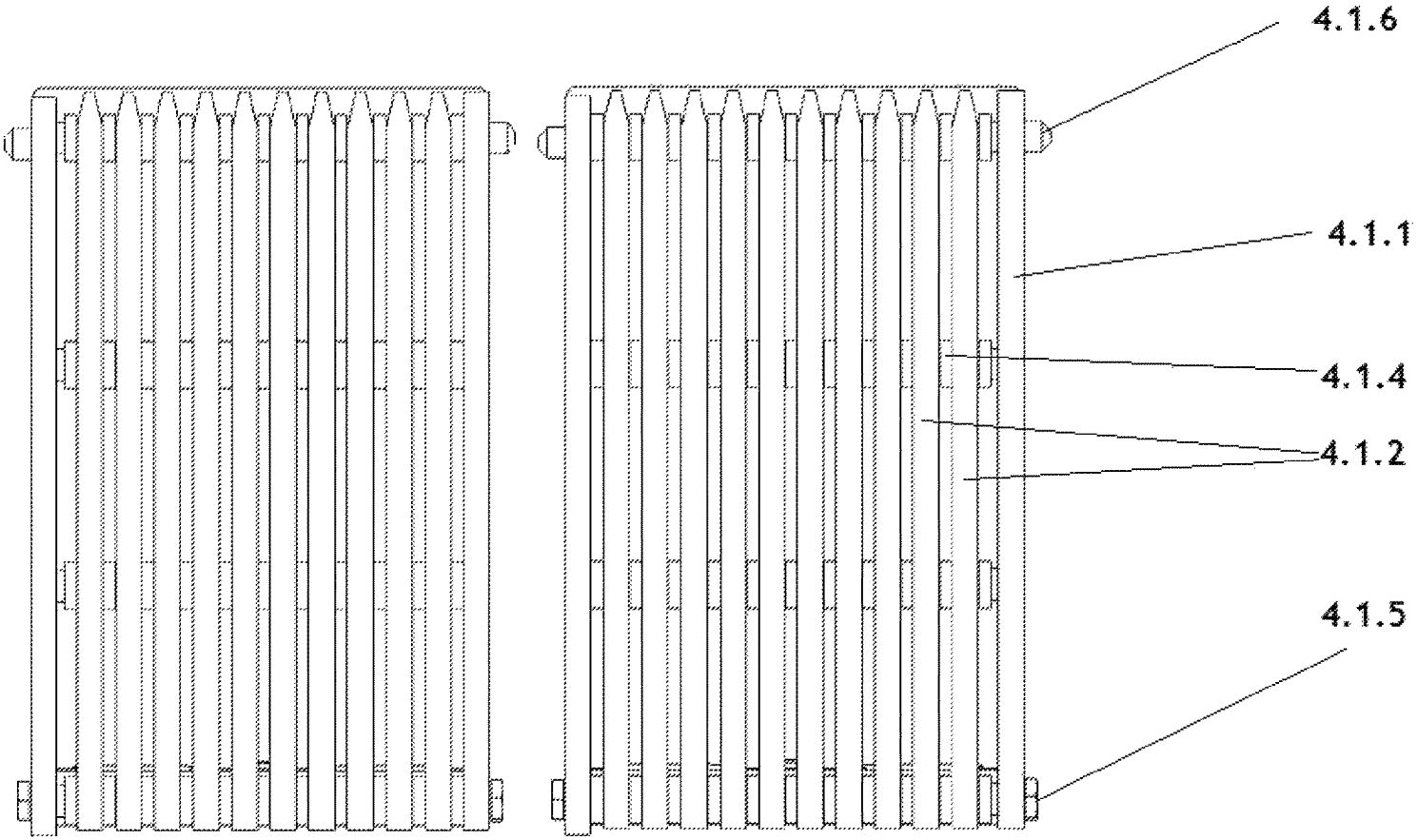
Figure 2D:
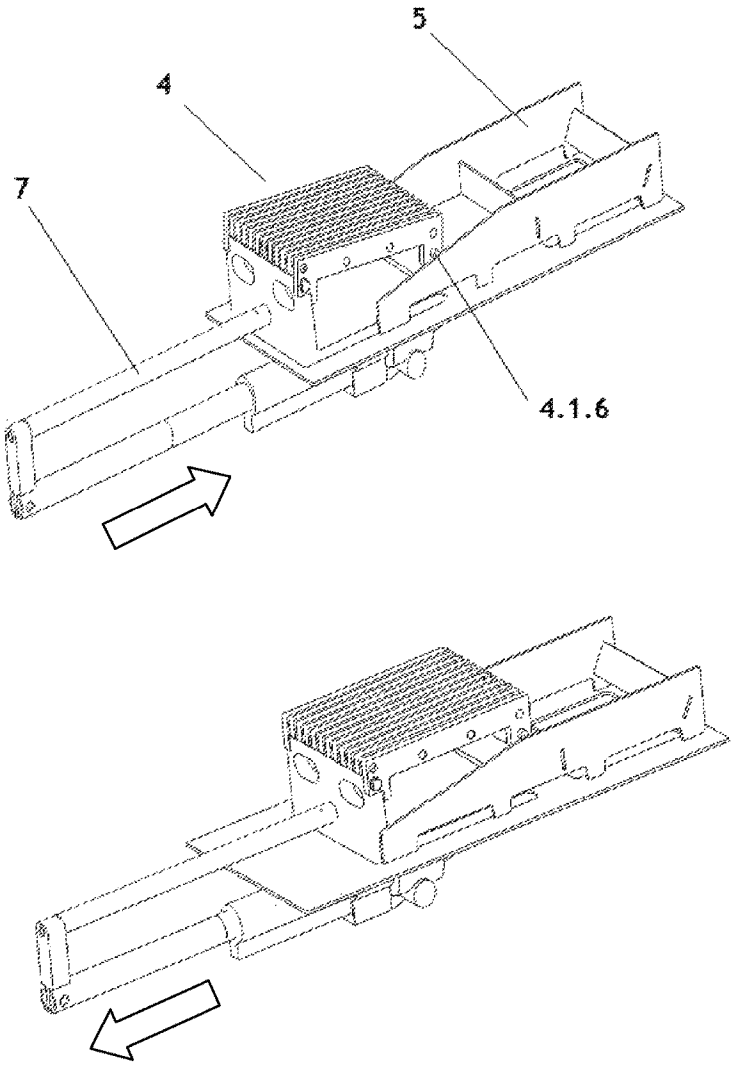
Figure 2E:
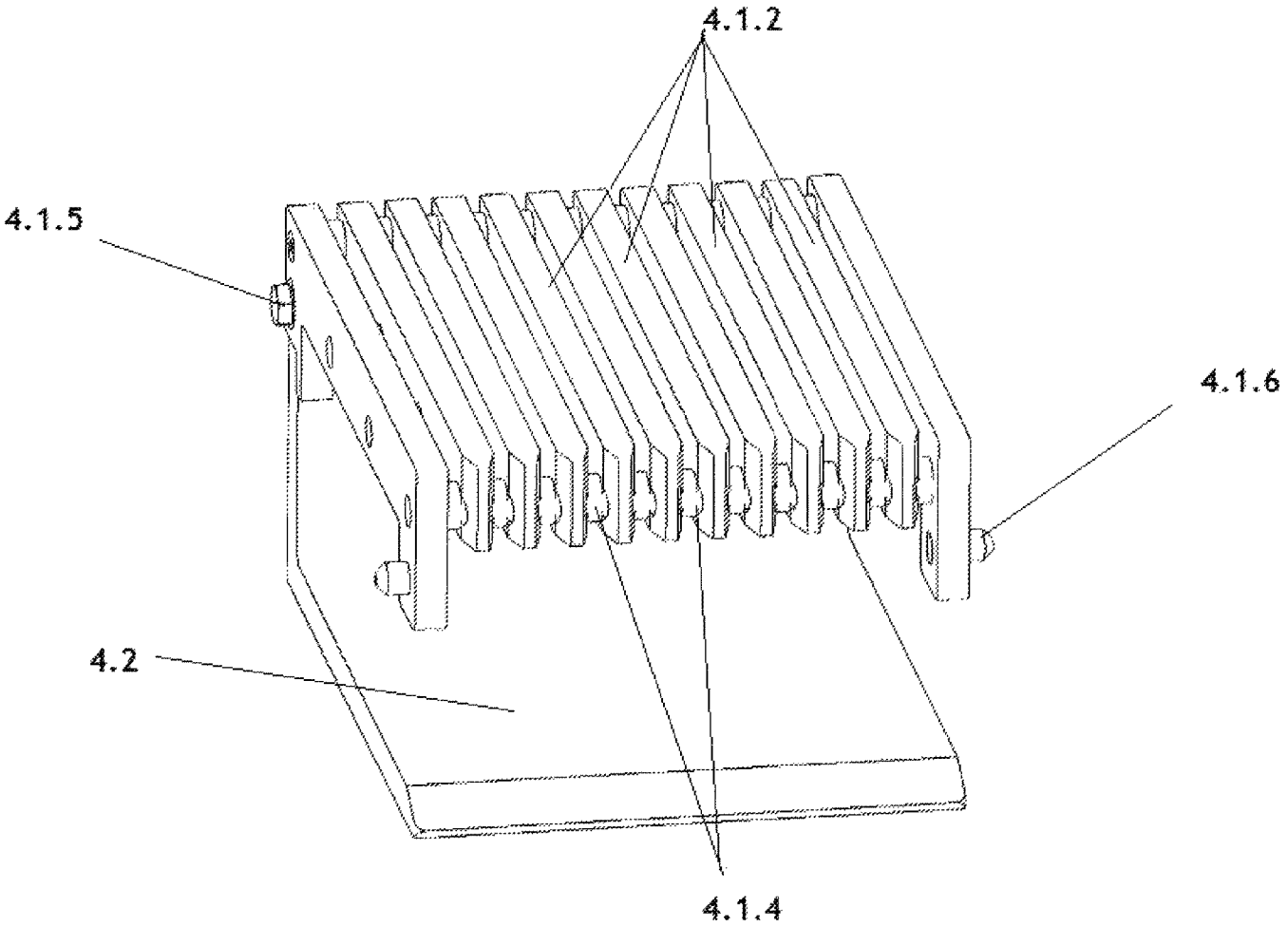
Figure 3:
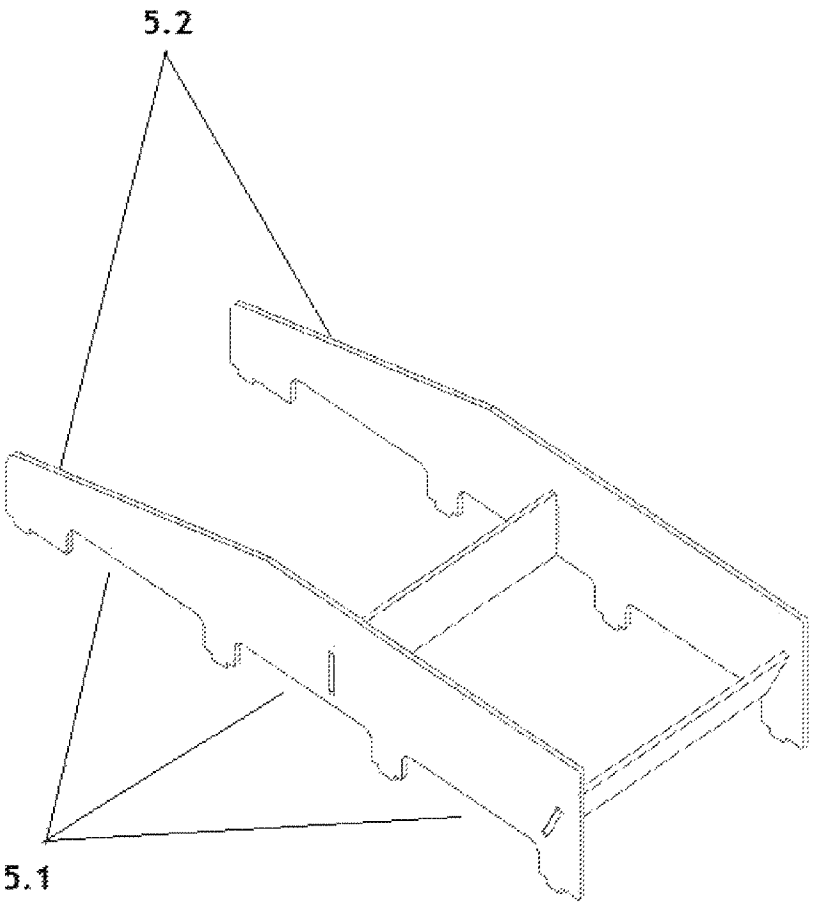
Figure 4:
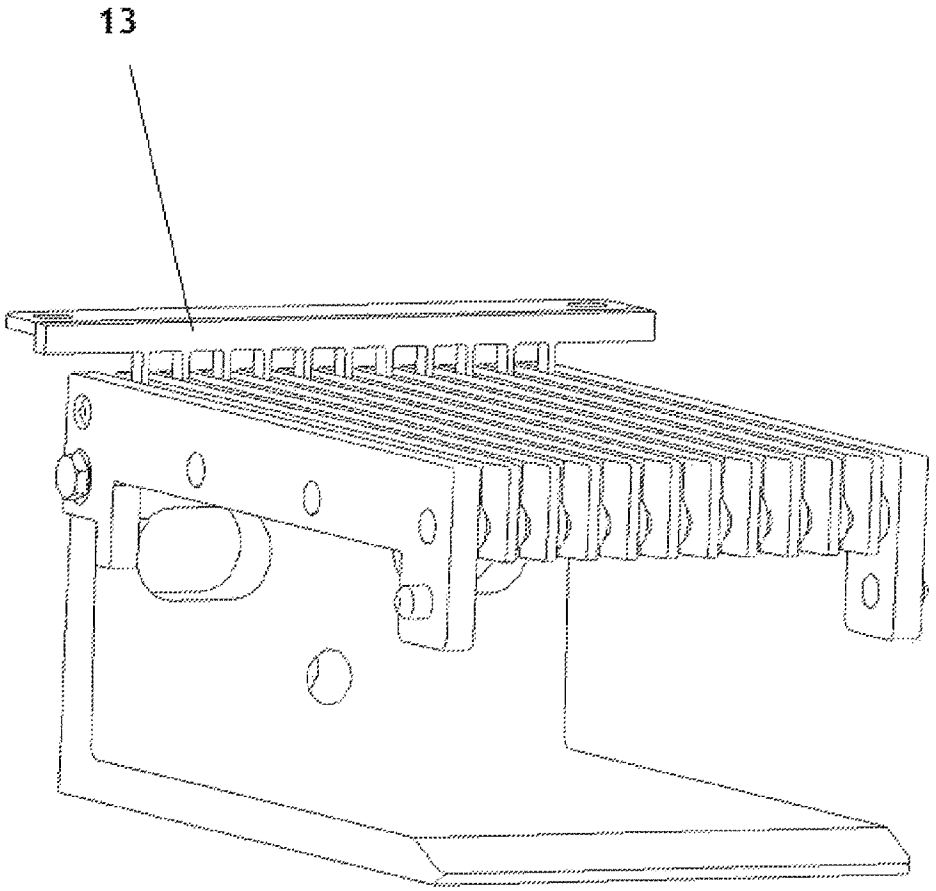

FIG. 2C—Is the view showing the movements of the grate arms independent from each other FIG. 2D—U shows the back and forth motion of the grate and the view of the other mobile parts during said movement FIG. 2E—shows the detail of the grate guide pins FIG. 3—is the detailed view of the uneven ramp (5.2) on which the grate guide pins move FIG. 4—shows the simultaneous operation of the grate arms and the sweeper.

Igniter

Figure 5:
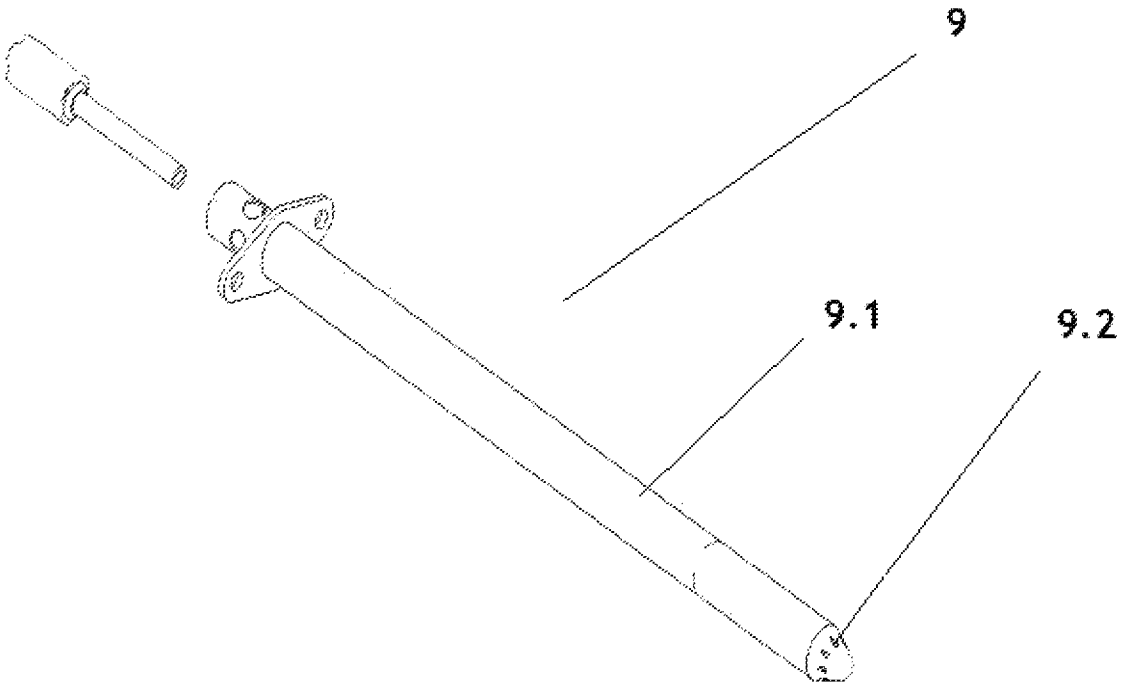

FIG. 5—is the detailed view of the igniter.

Combustion Chamber

Figure 6:
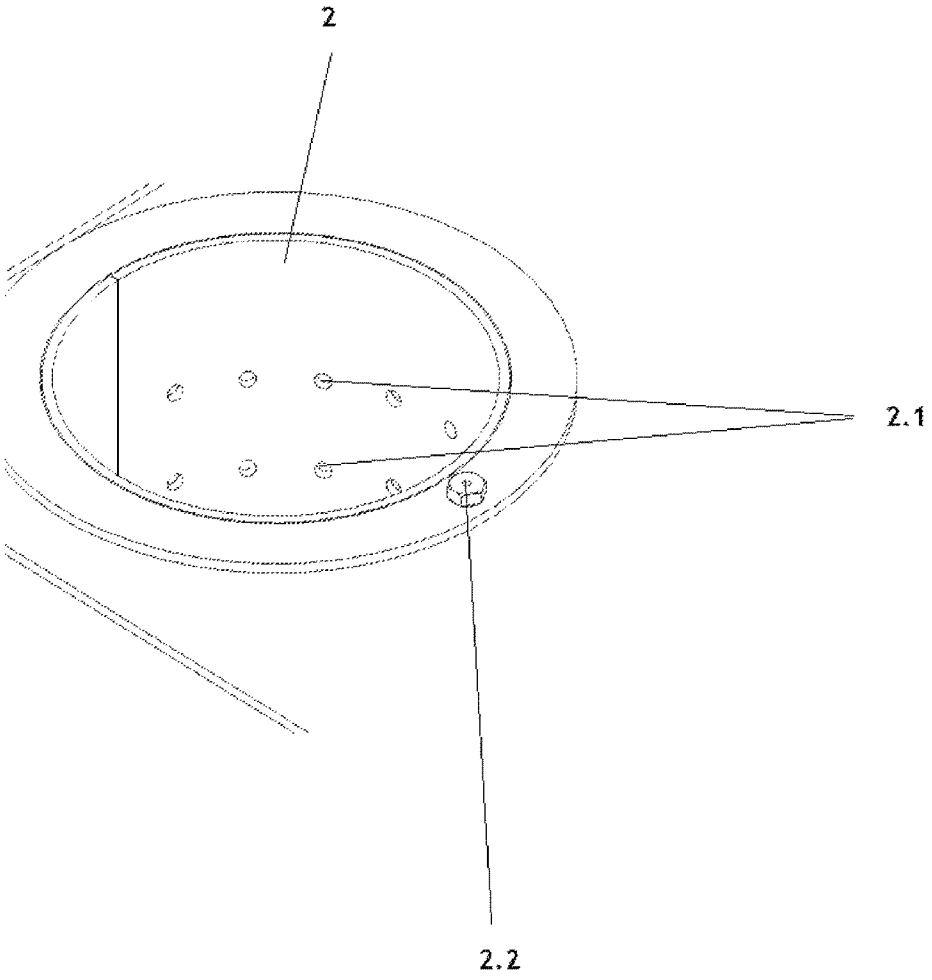

FIG. 6—Is the detailed view of the combustion chamber (together with the fixing screw)

DESCRIPTION OF THE PARTS SHOWN IN THE FIGURES

Part Names Shown in the Figures

1. Burner
- 1.1. Air separator

2. Combustion chamber
- 2.1. Combustion chamber secondary air inlets
- 2.2. Combustion chamber fixing screw
- 2.3. Secondary main air inlets

3. Primary air inlets

4. Mobile grate
- 4.1. Top grate
  - 4.1.1. Grate frame
  - 4.1.2. Grate arms
  - 4.1.3. Grate shafts
  - 4.1.4. Grate shims
  - 4.1.5. Shank
  - 4.1.6. Grate guide pins
  - 4.1.7. Support that limits downright motion
  - 4.1.8. Support that limits vertical motion
  - 4.1.9. Slot
- 4.2. Grate mount

5. Uneven rails
- 5.1. ash discharge aperture
- 5.2. Ramp

6. Ash discharge mouth

7. Linear thrusting shaft
- 7.1. Thrusting shaft cap connecting bolts

8. Linear thrusting motor
- 8.1. Connection pin

9. Electrical igniter
- 9.1. Conic Coating
- 9.2. Perforations

10. Photocell

11. Fuel feeding screw

12. Boiler-Burner connection bolts

13. Sweeper

14. Oscillating motor

15. Pressure sensor

16. Induced draft fan

17. Coil spring

18. Inner tubes

19. Ash carrying screw

DETAILED DESCRIPTION OF THE INVENTION

Heating structures that work with solid fuel basically are formed of 2 main parts. The first one of these is the boiler and the second is the burner. The burner carries out the combustion that is necessary to heat the fluid located inside the boiler; which is fed to the heating system. There are burners specially designed for many types of fuel types. The present invention relates to new design of a burner (1) structure that burns solid fuel and especially burns pellet type of fuels and olive stones and system parts that comprise the boiler as a whole.

In general boiler structures, in order for the heat that has been produced to be transferred to the heating fluid, flame smoke tubes are used. These tubes have been used for years. In some boilers of the previous technique, in order to prevent heat losses, turbulators have been used. However these turbulators create resistance at the exits of the hot gas stacks and said resistance causes the tubes to be contaminated rapidly thus creating unintended clogging in tubes. Due to this structure, it is impossible for the tubes to be cleaned without opening up the boiler. In the boiler subject to the present invention, inner tubes (18) and coil springs (17) which have been wrapped around said inner tubes (18) have been used inside the flame smoke tubes. By means of the coil spring (17) the result that is aimed to be reached by using the tube structure with turbulators can be reached and moreover, the inner tubes (18) in which soot accumulates over the tube membranes can be cleaned without the need to open up the boiler by means of the lifting up and releasing down motion applied to the coil springs (17) by the oscillating motor (14). As a result of the lifting up and releasing down motion the soot that has accumulated on the coil springs (17) and tube membranes pass through the boiler's combustion chamber and fall down on the ash collection area and from hereon the ash is carried out of the boiler by means of the ash carrying screw (19); thus performing the cleaning process. The first aspect of the invention that provides the basic features of the invention is that the burner (1) is a complete unit independent from the boiler and that it can be easily dismantled. For such a structure to be provided with a complex dismantling feature, makes it significantly difficult for the maintenance and repairs to be carried out on the burner (1) and due to the long periods of maintenance the continuous operation of the system is prevented and also it is sometimes difficult to carry out an effective cleaning process. In the present structure the burner (1) can be dismantled and taken out only by unscrewing 6 bolts (12). Moreover by just dismantling the thrusting shaft cap connecting bolts (7.1) and the connection pin (8.1) the mobile grate (4) structure can be taken out; which enables easy maintenance to be carried out on the grate (4) and also the aperture in which the grate (4) moves can also be reached and any kind of intervention inside to the burner can be feasibly carried out. An induced draft fan (16) is present at the flue exit of the boiler which controls the whole system and which provides the inlet of the necessary air into the boiler's combustion chamber. Air is sucked into the boiler's combustion chamber from the primary air inlets (3) and the secondary main air inlets (2.3) which are located on the burner (1) via the induced draft fan (16) and this ensures that the heat efficiency in the combustion chamber is increased to the highest levels. The primary air inlet (3) and the secondary air inlet (2.3) paths have been separated via an air separator (1.1) and the amount of air that shall pass through these air inlets can be arranged independently from each other. The top grate (4.1) slits and combustion chamber secondary air inlets (2.1) ensure that the air contacts the pellets burning on the top grate (4.1) from different angles and that said pellets are completely burned in the combustion chamber.

The most basic aspect that adds character to the system subject to the invention is that it comprises a mobile grate (4)

structure, linear thrusting shaft (7) and linear thrusting motor (8). The mobile grate (4) structure enables the ash, cinder and other unwanted wastes that accumulate on the top grate (4.1) surface and the grate channels to be discharged by means of the motion of the mobile grate (4) that is moved via the driving force provided by the linear thrusting motor (8) depending on the linear thrusting shaft (7).

As a whole the grate structure forms the section wherein the combustion is carried out on the floor of the burner combustion chamber located inside the burner (1). The pellets that are fed via the fuel feeding screw (11) into the burner combustion chamber (2) carry out the combustion process directly on said grate. The opening of the secondary air inlets (2.1) located on the combustion chamber (2) ensures that the combustion is completed and the CO value is decreased to the norm value that is preferred. Again in the present system, the ashes and cinders that remain out of the pellets that burn on the grate, fall down through the aperture defined as the ash discharge mouth (6) by means of the movement of the grate (4) structure and the ashes that fall down are collected inside the ash collection chamber or the ash collection section located underneath the grate.

The mobile grate (4) mentioned in the system subject to the invention has a U shaped structure and it stands at a 90° angle like a "⊂" at a clockwise direction inside the burner during combustion. By means of this form of the grate (4) structure, while the top section of the grate (4), or in other words the top grate (4.1) forms the floor of the combustion chamber (2), the bottom part of the grate (4) or in other words the grate mount (4.2) closes the discharge mouth (6). Moreover by this means, air passes through the primary air inlets (3) and directly below the top grate into the combustion chamber (2) thus defining the passage route of the primary airway. As the ash discharge mouth (6) opening up to the ash collection chamber, is closed with the grate mount (4.2) any excess air to enter from this section is prevented, and by the backwards movement of the grate mount (4.2) which moves together with the top grate (4.1) during the cleaning process it is enabled for the ashes to be dropped down into the ash collection chamber from the ash discharging mouth (6). In other words by means of this form, significant advantages have been obtained in controlling the air arriving from the primary air inlets (3) or even during cleaning.

The top part of the mobile grate (4) hosts the combustion chamber (2) and at the bottom section an ash discharge mouth (6) is present. The forward and backwards motion of the grate (4) basically is carried out between these above mentioned two parts. The mobile grate (4) structure fulfils the task of being the floor of the combustion chamber (2) during combustion and is moved into the aperture at the rear via the shim ling motion of the linear thrusting shaft (7) and the motor. By this way passage way between the combustion chamber (2) in this position and the ash discharge mouth (6) is formed and the ashes, cinder or other wastes are enabled to be dropped down directly from the ash discharge mouth (6).

One of the aspects within the scope of the invention is for the linear thrusting motor (8) which gives mobility to the mobile grate (4) to operate in certain time intervals depending on the instruction values received from the electric panel. For the linear thrusting motor (8) to work in certain time intervals and by discharging the ashes and cinder accumulated inside the combustion chamber (2) to be directly discharged from the combustion chamber, it is enabled for all of the fed fuel to be combusted in the best way possible.

The sweeper (13), which is located at the front part of the combustion chamber (2), provides for the wastes to be efficiently swept and discharged out of the ash discharge mouth (6) which accumulate on the grate channels by sweeping said grate channels located on the top grate (4.1) during the backwards pulling motion of the mobile grate (4) structure.

The U shaped grate (4) structure mentioned above basically comprises 2 parts. The part defined as the top part, is the top grate (4.1) section that forms the floor of the combustion chamber (2). The top grate (4.1) section is formed of grate arms (4.1.2) that are each separate parts and shafts (4.1.3) that connects these arms and a grate frame (4.1.1). On each of the grate arms (4.1.2) slots (4.1.9) that are large enough to allow the grate shafts (4.1.3) to pass through them are present. The diameter of these slots (4.1.9) are larger than the diameters of the grate shafts (4.1.3) that enable the free movement of the grate arms (4.1.2) on the grate shafts (4.1.3) either before expansion or following expansion. Moreover shims (4.1.4) that allow cavities to be present between each of the grate arms (4.1.2) are also provided.

The grate arms (4.1.2), grate shafts (4.1.3) and grate frame (4.1.1) are made of stainless steel, preferably from 310S type stainless steel. However for the grate arms (4.1.2) and grate shafts (4.1.3) to be basically separate parts from each other, and for these parts being not connected to each other by welding etc, any kind of deformation arising from expansion due to heat, and shrinkage is avoided and in turn the closing of the cavities of the grate channels are prevented. Depending on this, the grate cavities even in long terms of usage allows the discharging of fuel wastes without any need of external intervention and the time to combine and produce said independent parts are decreased. By this means, one of the most important problems which is the maintenance and cleaning time intervals for pellet boilers are increased and the system is enabled to work with the same efficiency for a longer period of time without the necessity to carry out any sort of additional maintenance on the system.

Actually by courtesy of the grate (4) structure subject to the present invention, it is allowed for the grate arms (4.1.2) and the grate shafts (4.1.3) to expand in such a way that said expansion does not deform the grate structure, rather than resist the expansion caused due to heat. Moreover the grate arms (4.1.2) and the shims (4.1.4) can move freely over the shaft (4.1.3) even after the completion of the mounting process can come close to each other as far as the wall thickness of the shim (4.1.4) or the shim can drift further apart even more than the width of the wall thickness. This distance value must be at a level which can prevent the unburned fuel to pass through the grate and fall down. The distance between two grate arms must be at a ratio between 25%-75% of wall thickness of each grate arm. By this means superiorities regarding the optimum air inflow and combustion efficiency has been determined. Furthermore as the grate arms (4.1.2) can freely move among themselves, the jamming of the sweeper (13) between the grate arms (4.1.2) which expand and shrink due to heat as a difference from the systems of the previous art is prevented, thus allowing the cinders that have accumulated between the grate arms (4.1.2) to be properly swept. This in turn provides a system to the user which does not need any extra maintenance by increasing the time intervals between the external maintenance periods and increasing heat efficiency.

In addition to this, the tips of the grate arms (4.1.2) have been sharpened at a form looking like the tip of an arrow ">". As the tips of the grate arms (4.1.2) have not been closed off in any way with another piece, the grate arms (4.1.2) are allowed to expand in a plane as requested and the sweeper is allowed to enter between the channels of the grate arms (4.1.2) thus ensuring cleaning is carried out in the best way possible. In order to allow the expansion of the grate shafts (4.1.3) produced from stainless steel in a horizontal plane, the shafts are allowed to enter the cavities opened in the grate frame (4.1.1) and as one side is not fixed the shafts (4.1.3) are allowed to expand out of the frame (4.1.1) thus ensuring that the deformation of the grate is prevented.

The grate mount (4.2) which forms the bottom part of the U shaped grate (4) is produced from cast material and is basically positioned as the support mount of the top grate (4.1). the front part of the grate mount (4.2) has been inclined like a ramp (5.2) in order to be able to sweep the scattered fuel waste and cinders. By this means the accumulated ash is collected on the grate mount (4.2) during the back and forth movement of the U shaped grate (4) and during the motion backwards said ash falls down and possible clogging is prevented. Another basic function of the grate mount (4.2) is that during the combustion the ash discharge mouth (6) is closed and any unwanted air entry from the ash chamber is prevented; and during the cleaning process said ash discharge mouth (6) is opened and the ash is allowed to fall into the ash chamber.

This top grate (4.1) structure which is formed by the grate arms (4.1.2), grate shafts (4.1.3) and the grate frame (4.1.1) has been connected to the grate mount (4.2) via a shank. By means of the shank (4.1.5) the top grate (4.1) structure can move downwards and upwards. The aim of this mobile top grate (4.1) is to prevent the lock down of the system due to spasms caused by the accumulated cinders, which have accumulated under the grate mount (4.2) in the forward and backwards motion of the U shaped grate (4). During the tests carried out, it has been found out that when the top grate (4.1) is produced as a fixed system, cinders tended to accumulate at the bottom grate mount (4.2) of the U shaped grate (4) and said accumulation then tended to block the U shaped grate produced from a single piece cast material thus causing the system to lock down. In order to find a solution to this problem the structure of the top grate (4.1) was designed such that it could move up and down on the mount (4.2). However it should not be forgotten that the top grate (4.1) also forms the floor of the combustion chamber (2), and it should be kept in mind that the top grate (4.1) should form a plane parallel to the floor without being bent down during the combustion process. During the combustion process, in order for the top grate (4.1) not to bend down and to form a base parallel to the floor, the edges of the grate frame (4.1.1) have been fitted with guide pins (4.1.6). To ensure that the grate guide pins (4.1.6) are least affected by the heat of the top grate (4.1) the frame has been fitted at the furthermost tips of the arms of the frame (4.1.1). In order for these guide pins (4.1.6) to give an upwards motion to the top grate (4.1), uneven rails (5) have been mounted at the inner base of the burner (1). The guide pins (4.1.6) enable the pushing upwards of the tip of the top grate and ensuring the grate is parallel together with the thrusting force by moving over said uneven formed rails (5). During the thrusting motion, the inclined portion on the sharp points of the uneven rails (5) of the grate guide pins (4.1.6) act like a ramp (5.2) and by thrusting, said portion gradually elevates up and ensures that the top grate (4.1) which forms the floor of the combustion chamber is parallel to the floor on the plane of the incline. Furthermore, butt end discharge aperture (5.1) for discharging ashes have been opened at the bottom section of said uneven rails (5), thus enabling the discharging of cinders that have accumulated between the uneven rails (5) during the pushing and drawing back motion without causing the system to lock down.

Supports that limit the motion (4.1.7,4.1.8) at the connection section of the shank (4.1.5) of the grate frame (4.1.1) are present in order to determine the borders of the up and down motion of the top grate. While the shank (4.1.5) provides up and down motion to the top grate (4.1) it at the same time limits the downwards motion of the top grate (4.1) by means of the downwards support limiter (4.1.7) on top of the frame (4.1.1) thus ensuring operation is continued at a certain angle distance. Again similarly the motion of the shank (4.1.5) which allows the motion of the top grate (4.1) upwards at a certain angle has been limited with the second support limiter (4.1.8) located behind the frame (4.1.1). The preferred movement angle of the top grate (4.1) is envisaged as at most 10 upwards and at most 10° downwards.

Different to the known igniters of the previous technique in the system subject to the invention at least 2 igniters (9) have been used. Thus it has been enabled for the initial flame established by the igniter (9) to be more homogenous and a more efficient ignition has been obtained. Also in order to shorten the ignition process and to increase the operation life of the igniters (9), ceramic based igniters (9) have been used instead of steel based igniters. Again different to the igniters of the previous technique, a special conic coating (9.1) has been applied in order to define the distance of the igniters to the fuel and for the igniters (9) to be protected within the burner (1). The tip of the coating (9.1) is conical and perforations (9.2) at the edges of the cone have been opened. Thus it has been ensured that any unwanted fuel from the combustion chamber and various particles are prevented from entering into the slot of the igniter (9). In the case that the igniters (9) are brought close to the combustion chamber, although it is known that a faster ignition will be achieved it is also known that such close proximity will also shorten the life span of the igniter (9). For this reason in the situation that the igniters (9) are located at a 1-5 cm distance to the combustion chamber, both a better combustion is achieved and a significant increase in the life span of the igniter (9) has also been determined.

Another aspect that adds character to the invention is that the screw (2.2) is designed with a hollow middle section which allows the passage of air through it; said screw ensures that the combustion chamber (2) is fixed to the burner (1) and that said screw (2.2) is also fixed at the opposite direction to the mouth which fuel is fed from to the combustion chamber. As the mid section of the screw (2.2) is hollow, air flows through the screw (2.2) and said screw (2.2) is cooled. As the same screw (2.2) is fixed at the opposite part of the fuel feeding section, the screw is subjected to less amount of heat. As a result of all of these studies it has been perceived that the screw threads of the screw (2.2) do not melt due to heat thus being prevented to stick onto the combustion chamber (2) and said screw (2.2) can be easily dismantled during maintenance procedures.

In addition to the above mentioned aspects, the heating system comprises an electric panel in order to ensure that the motor connected to the fuel feeding screw (11), the linear thrusting motor (8) connected to the mobile grate (4) structure, the motor connected to the ash carrying screw (19) the oscillating motor (14) which shakes the coil springs (17) can operate simultaneously or separately from each other. The principal of the operation of the electric panel is based on a pressure sensor (15) which measures the pressure values of the air inside the system and on at least two photocells (10) that continuously monitor the flame. In the system subject to the present invention 2 photocells (10) are proposed to be used. By this means perception from the combustion chamber even if the flame is in different sections in the chamber can be achieved. The pressure sensor (15) transfers the measured pressure following the confirmation taken from the photocells (10) to the electric panel and said electric panel operates the screw motor carrying the fuel, the fuel feeding driving motor and the induced draft fan (16) simultaneously or separately in accordance with the obtained pressure values.

The invention claimed is:

1. A burner (1) comprising a mobile ash discharging/cleaning system, a combustion chamber, air inlet, fuel feeding system and air fan, operating automatically on solid fuel, characterized in that; the mobile grate (4) of the burner (1) has a U shaped structure comprising:

grate arms (4.1.2) that can move over grate shafts (4.1.3) wherein the grate shafts are each independently movable;

a grate frame (4.1.1) wherein the grate shafts (4.1.3) connect the grate arms (4.1.2) to each other and to the grate frame (4.1.1) by passing through slots (4.1.9) on the grate arms (4.1.2);

grate shims (4.1.4) located on the grate shafts (4.1.3) and between the grate arms (4.1.2);

a shank (4.1.5) connecting the grate arms (4.1.2) to the grate frame (4.1.1) forming a top grate (4.1) that is coupled to a grate mount (4.2) and wherein the top grate (4.1) is movably coupled to the grate mount (4.2);

uneven rails (5) on which the top grate (4.1) may move;

grate guide pins (4.1.6) that allow movement of the top grate (4.1) on the uneven rails (5);

a support (4.1.7) that limits the motion of the top grate (4.1) when the top grate is moved toward the grate mount (4.2);

another support (4.1.8) that limits the movement of the top grate (4.1) when the top grate is moved away from the grate mount (4.2); and wherein a mobile grate (4) having the U shaped structure and including the grate mount (4.2) is positionable inside the burner and may be moved to open and close an ash discharging mouth (6) on the burner.

2. The burner (1) according to claim 1 characterized in that; diameters of the slots (4.1.9) are larger than diameters of the grate shafts (4.1.3) and wherein the grate shafts (4.1.3) enable the free movement of the grate arms (4.1.2) even when subjected to heat.

3. The burner (1) according to claim 1 characterized in that; the grate mount (4.2) is produced from cast material and the front of the grate mount (4.2) is shaped like a ramp (5.2).

4. The burner (1) according to claim 1 characterized in that; the grate shafts (4.1.3) and the grate frame (4.1.1) are produced from stainless steel.

5. The burner (1) according to claim 1 characterized in that; the burner comprises a linear thrusting shaft (7) and a linear thrusting motor (8) that moves the mobile grate (4) back and forth.

6. The burner (1) according to claim 1 characterized in that; the top grate (4.1) forms a base parallel to a floor during combustion and the grate guide pins (4.1.6) are placed at the edges of the grate frame (4.1.1) thereby keeping the base parallel to the floor by preventing bending of top grate (4.1).

7. The burner (1) according to claim 1 characterized in that; the uneven rails (5) are placed inside an inner base of the burner (1), support grate guide pins (4.1.6), and enable movement of the top grate (4.1) when the mobile grate (4) is moved to open and close the ash discharging mouth (6).

8. The burner (1) according to claim 1 characterized in that; ash discharge apertures (5.1) are underneath the uneven rails (5).

9. The burner (1) according to claim 1 characterized in that; wherein the top grate (4.1) is capable of moving between 10° away from and 10° towards the grate mount from a parallel position.

10. The burner (1) according to claim 1 characterized in that; the burner (1) comprises a sweeper (13) which sweeps grate gaps on the top grate (4.1) during a drawing back motion of the mobile grate (4) structure thus ensuring accumulated waste is swept out efficiently.

11. The burner (1) according to claim 1 characterized in that; the burner (1) comprises a primary air inlet (3) and a secondary air inlet (2.3) and an air separator (1.1) that directs air that passes through at least one of the air inlet and the secondary air inlet to different directions.

12. The burner (1) according to claim 1 characterized in that; the burner (1) comprises at least 2 ceramic igniters (9), each having a conical tip with at least 3 perforations located at the base of the conical tip.

13. The burner (1) according to claim 12 characterized in that; the ceramic igniters (9) are located at a distance of 1-5 cm from the combustion chamber.

14. The burner (1) according to claim 1 characterized in that; at least 2 photocells (10) are used.

* * * * *